United States Patent [19]

Mills et al.

[11] Patent Number: 4,920,382

[45] Date of Patent: Apr. 24, 1990

[54] FIXING METHOD FOR RESIN BASED SHEETS

[75] Inventors: Borden H. Mills; David F. Cahill, both of Rochester, N.Y.

[73] Assignee: Eastman Kodak Company, Rochester, N.Y.

[21] Appl. No.: 223,829

[22] Filed: Jul. 25, 1988

[51] Int. Cl.[5] ..... G03G 15/20

[52] U.S. Cl. ..... 355/284; 118/60; 219/216; 355/326

[58] Field of Search ..... 432/60; 355/14 FU, 3 FU; 430/98, 99, 124; 219/216; 118/60

[56] References Cited

U.S. PATENT DOCUMENTS

| | | | |
|---|---|---|---|
| 3,706,491 | 12/1972 | Furman et al. | 355/3 FU X |
| 4,008,955 | 2/1977 | Bar-on | 355/3 R |
| 4,040,383 | 8/1977 | Vandervort | 118/60 |
| 4,045,165 | 8/1977 | Nakajima et al. | 432/60 |
| 4,272,666 | 6/1981 | Collin | 219/216 |
| 4,285,295 | 8/1981 | Iwao et al. | 432/60 X |
| 4,367,690 | 1/1983 | Sakaguchi et al. | 432/60 X |
| 4,429,990 | 2/1984 | Tamary | 355/14 FU |
| 4,549,803 | 10/1985 | Ohno et al. | 355/14 FU |
| 4,593,992 | 6/1986 | Yoshinaga et al. | 355/3 FU |

FOREIGN PATENT DOCUMENTS

| | | | |
|---|---|---|---|
| 0129634 | 5/1981 | Japan . | |
| 0176075 | 9/1985 | Japan | 355/3 FU |
| 0263180 | 12/1985 | Japan | 355/3 FU |

*Primary Examiner*—A. T. Grimley
*Assistant Examiner*—Robert Beatty
*Attorney, Agent, or Firm*—Leonard W. Treash

[57] ABSTRACT

A roller fixing device, for example, a pressure roller fuser includes a roller to which a release agent is to be applied by a wick. To correct a tendency of certain wicks to apply the release liquid in a pattern including spots of locally excessive liquid, the wick is disengaged from the roller sufficiently prior to the fixing operation to permit the liquid to spread eliminating the spots of locally excessive liquid. Preferably, the roller completes at least one revolution in contact with another roller after disengagement and prior to the beginning of fixing. To assist that spread, a sheet of more absorbent material, for example paper, is fed through the fixing operation during this period. This mode of operation is used for specific receiver sheets and toner conditions, for example, those encountered in making color transparencies. A more conventional wicking mode is used for other reproductions on paper and black toner transparencies.

7 Claims, 2 Drawing Sheets

FIXING METHOD FOR RESIN BASED SHEETS

FIELD OF THE INVENTION

This invention relates to methods and apparatus for fixing toner to a receiving sheet, and more specifically to such devices and apparatus in which a release liquid, for example, a silicone oil, is applied to the surface of a roller which contacts the toner image to prevent offset of toner onto that surface. The invention is particularly usable in a color printer or copier in which color toner images are fixed to resin based materials, for example, transparent materials.

BACKGROUND OF THE INVENTION

U.S. Pat. No. 4,429,990 issued February 7, 1984 to E. J. Tamary shows a pressure roller fuser of a type presently commercially used to fix toner images to support sheets. An important aspect of that disclosure is a mechanism for applying release liquid to a fusing roller which contacts the toner image. That liquid applying mechanism, commonly called a rotating wick, includes a hollow porous roller, which is supplied with fuser oil internally. The applicator has an inner supply tube with holes in it and is covered by a porous material having a surface of wool or a heat resistant synthetic wicking material. The applicator is rotatable by the fusing roller and thoroughly applies the liquid with minimum wear to the roller. The applicator is movable into and out of engagement with the roller according to a program which prevents excess buildup of oil on the roller which otherwise would stain the image bearing sheet. This general type of structure is relatively inexpensive to manufacture and is effective in applying oil to rollers, both of the type in which oil is applied to one roller and also of the type shown in the patent where the oil is supplied by separate wicks to both rollers.

However, because the wick structure directly contacts the roller and rolls with it, it has a tendency to leave the liquid in a fine pattern consisting of spots of locally excessive liquid. These spots may impede transfer of heat energy from the fusing roller to the toner. With ordinary paper support sheets, the release liquid is readily absorbed and the spots of excess liquid have no adverse effect. Resin based stock, for example transparency stock, does not absorb the liquid and small spots of incomplete fusing can result. These spots are not generally noticed when black toner is used on transparencies. However, even a small amount of incomplete fusing of a color transparency will show up as gray or black spots in a projected color image using that transparency. The present tendency of the art to use very viscous silicone oils as the release liquid has increased this problem of locally excessive liquid.

A number of references show approaches to improving fusing oil control in fusing transparencies; see for example U.S. Pat. Nos. 4,549,803 and 4,593,992. In both of these patents, fixing conditions are changed when the sheet carrying the toner image is a synthetic resin rather than paper. To improve fixing for transparency stock, an obvious solution is to slow the fixing apparatus down or increase the temperature to thereby apply more power to each unit of area to be fused. Obviously, if transparency stock absorbs less release liquid, the amount of liquid applied can be reduced as well. In these two patents this is accomplished by articulating a wick that applies release liquid to an application roller or by control of various spreading and cleaning devices in the system. These patents deal only with the problem of excessive liquid on transparencies in general not with the problem of locally excessive spots of liquid imparted by the wicking structure itself.

The Tamary patent is representative of a number of other patents which show articulating wicks for pressure roller fixers; see for example U.S. Pat. No. 4,008,955; U.S. Pat. No. 4,045,165 and U.S. Pat. No. 4,272,666.

SUMMARY OF THE INVENTION

It is the object of this invention to better control the release liquid applied to a surface in a fixing device of the type described.

This and other objects are accomplished by a method and apparatus, which method includes the steps of applying release liquid directly to a roller surface by engaging the surface with a wicking surface, terminating the application of release liquid to the surface a sufficient length of time prior to the fixing operation that when the fixing operation is carried out any irregularity imparted to the surface of the release liquid on the roller by the application step has been substantially lessened.

Preferably, the roller makes at least one revolution in contact with a pressure roller after disengagement of the wicking surface and prior to the beginning of fixing.

According to a further preferred embodiment the method also includes the step of contacting the surface with a sheet of material more absorbent of said liquid in the interval between separation of the wick from the roller surface and the beginning of the fixing process.

Apparatus constructed according to the invention includes means for applying a viscous release liquid directly to the surface of one of the rollers, means for moving the applying means into and out of engagement with the surface to control the amount of liquid applied to the roller and control means for controlling the moving means. The apparatus has a first mode of operation in which the control means causes the moving means to move the applying means into such engagement according to a first program designed to prevent general buildup of release liquid on the roller. This mode could be used for fixing toner on paper supports and black toner transparencies. The apparatus has a second mode of operation used for specific receiver sheet and toner conditions particularly sensitive to spots of locally sensitive liquid, for example, color transparencies, in which the control means causes the moving means to move the applying means according to a second program causing the applying means to be removed from engagement with the roller sufficiently in advance of arrival of the sheet that any irregularity imparted to the surface of the release liquid on the roller by the wick has been substantially lessened by the time the sheet contacts the roller.

DESCRIPTION OF THE DRAWINGS

In the detailed description of the preferred embodiment of the invention presented below reference is made to the accompanying drawings, in which.

BEST MODE OF CARRYING OUT THE INVENTION

Figure 1:
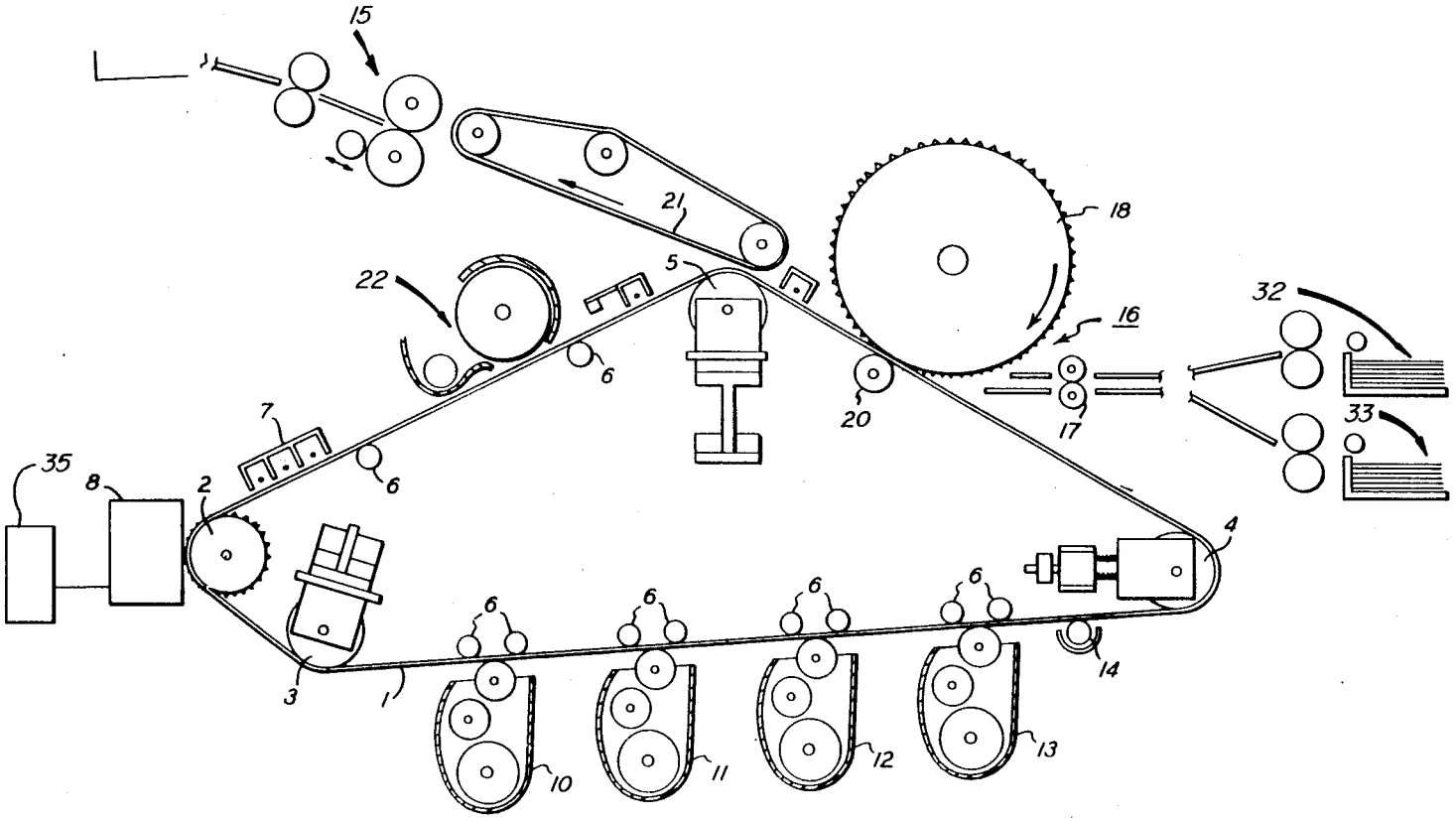
FIG. 1 is a schematic side view of a printer or copier constructed according to the invention with parts eliminated for clarity of illustration.

According to FIG. 1, a film core portion of a copier or printer includes an endless moveable web, for example an electrophotographic web 1 entrained about a series of primary rollers 2,3,4, and 5 and other supporting structure, for example, film skis 6.

The web is driven through a series of electrophotographic stations generally well-known in the art. More specifically, a uniform charge is laid down on the electrophotographic web 1 at a charging station 7. The uniformly charged web moves around printhead roller 2 which is directly opposite an LED printhead 8 which LED print head exposes the web 1 in a manner well known in the art. The web then moves into operative relation with a series of toner stations 10, 11, 12, and 13. Each image created by exposure is toned by one of the toner stations. After being toned, the web passes a magnetic scavenger 14, which removes excess iron particles picked up in the toning process. After the electrostatic image has been toned, the web passes to a transfer station 16 where the image is transferred to a transfer surface. The transfer surface is one surface of a copy sheet which has been delivered by a copy sheet feeding mechanism 17 to the transfer station 16. The transfer station 16 includes a transfer drum 18 and backup roller 20 to which the copy sheet is secured for repeated presentations to web 1.

When the apparatus is operating in a multi-color mode consecutive images or pairs of images are toned with different colored toners using the different toning stations 10–13. These consecutive images are transferred in registry to the transfer surface as it repeatedly is brought into transfer relation with the web 1 by the drum 18. After the transfer operation is complete, the copy sheet is allowed to follow the web, for example by removing a vacuum holding it to the drum or by stripping the sheet with a claw or other conventional stripping mechanism, not shown. The copy sheet is separated from the web with the aid of a sheet transport mechanism 21 and is transported to a fixing device 15, more thoroughly described below. The web is then cleaned at cleaning station 22 and the process repeated.

Figure 2:
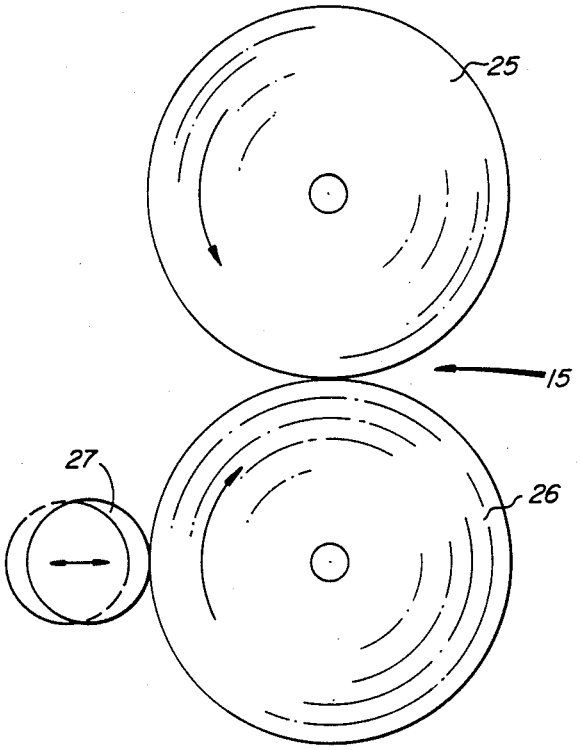
FIG. 2 is a side view of a fixing device constructed according to the invention and usable in the printer or copier shown in FIG. 1.

The fixing device 15 is a roller fuser similar to that shown in U.S. Pat. No. 4,429,990, Tamary, discussed above, disclosure of which patent is incorporated by reference herein. Referring to FIG. 2, the fixing device or roller fuser 15 includes a pressure roller 25 and a fusing roller 26. The fusing roller is heated and is intended to contact the toner bearing surface of the copy sheet. At least one of the rollers is soft enough to create a nip of sufficient length that the combination of heat and pressure fixes the toner to sheets passing through the nip, all as is well known in the art.

Figure 3:
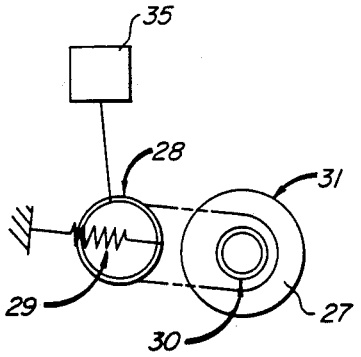
FIG. 3 is a side schematic view of a wick articulating structure constructed according to the invention.

A rotating wick 27, similar to that shown in said Tamary patent, is mounted for articulating movement as shown in FIG. 2 into and out of engagement with the fusing roller 26. As shown in FIG. 3, and as is described in more detail in said Tamary patent, articulation of the rotating wick is accomplished by an air bladder 28 and retraction spring 29. As air is supplied to the air bladder 28 the wick 27 is moved against the urging of retraction spring 29 into engagement with the roller 26. As air is removed from the air bladder 28, the retraction spring disengages the wick from fusing roller 26. Alternatively, a set of cams or other known device can be used to articulate the wick. The wick itself is of complex construction. It includes a distribution tube 30 through which a viscous release liquid, such as silicone oil, is pumped. The release liquid passes through holes in the distribution tube 30 to a fabric covering 31. If needed, an intermediate porous material, not shown, can be positioned between the tube 30 and the fabric covering 31 to help spread the liquid. The porous materials permit the viscous liquid to spread, applying it sufficiently evenly to the fusing roller for normal operation. However, local spots of excess liquid do result on the fusing roll due to the irregular texture of the fabric and imperfections in the distribution system. The fabric itself may be wool, or other natural fabric. However, the most common material used is a heat resistant synthetic fabric marketed by DuPont under the trade name NOMEX.

According to the above mentioned Tamary patent, the rotating wick is articulated according to a program that applies the liquid to the fusing roller 26 prior to the entry of the first sheet carrying a toner image into the nip and continues that application until a logic and control unit determines that there has been a buildup of release liquid to a point beyond which staining and other problems associated with insufficient fusing might occur. At this point the logic and control unit shown in Tamary releases the air pressure in the air bladder 28 thereby disengaging the wick for a period of time or copy sheet count at which point it is reengaged. This mode of operation is desirable for use in the apparatus shown in FIG. 1 when operating with images carried on ordinary paper sheets and is a first mode of operation of this apparatus. However, when transparency stock, especially with color toner images, is passed through the user, the irregular fabric surface of the wick leaves a pattern in the release liquid on the fusing roller of excessive liquid in certain spots. Those spots show up as gray or black when the transparency is projected because of scattering of light by inconsistently fused toner.

To solve this problem, it has been found that if the fuser is operated for a period of time after disengaging the rotating wick 27, the surface tension of the liquid itself has a tendency to even out these localized spots and greatly lessen the problem. If the fusing and pressure rollers are rolled in contact during this period of time, the pressure roller contributes to the smoothing process. The problem is further lessened if a piece of more absorbent material, for example, paper is run through the fuser prior to fusing the color transparency, i.e., during the same time period. In a machine that produces both mono-color copies on paper stock and multi-colored transparencies, it is common to slow the fusing speed down for the multi-colored transparency to also enhance fusing, see U.S. Pat. No. 4,549,803, mentioned above. This can be done because the multi-color mode of machines constructed according to FIG. 1 requires a superposition of 2, 3, or 4 images to make a single multi-color image, which image passes through the fixing device only once. The apparatus thus has an inherently lower output in the fixing device.

Thus, the printer or copier, according to the invention, has a second mode of operation for certain specific receiver sheet and toner conditions in which a control means 35 causes the moving means 28 and 29 to move the rotatable wick 27 into engagement with the roller 26 to apply release liquid thereto substantially prior to fixing said special receiver sheet. The moving means 28 and 29 then removes the wick 27 from such engagement a sufficient time that in advance of the arrival of a sheet having a toner image to be fixed that any irregularity imparted to the surface of the release liquid on the roller by the wick has been reduced.

According to a preferred embodiment, during that time, after disengagement of the wick 27 and the roller 26, a sheet of ordinary paper is fed through the system which also smooths the liquid and absorbs any excess liquid prior to arrival of the special stock, i.e., the transparency stock. According to FIG. 1, this aspect of the invention can be best accomplished when transparency stock is fed from a first paper sheet supply 32 and sheets of paper, which need not be the same size, are fed from a second sheet supply 33 using sheet feeding mechanisms well-known in the art.

Thus, in the preferred embodiment, a signal is sent to logic and control means 35 that a color transparency is to be produced. This signal can be provided by a switch on the control panel of the printer or copier or as part of the programming of the apparatus. The logic and control then switches the copier or printer to the second mode of operation. In this mode, the logic and control means 35, in conjunction with the rest of the timing of the printer or copier, clocks a period of time prior to arrival of the transparency at the fuser. That time period is preferably sufficient to allow at least two turns of fusing roller 26. Bladder 28 is energized moving the rotating wick 27 into engagement with fusing roller 26 to deposit release liquid thereon. After approximately one rotation of fusing roller 26, an appropriate signal then causes bladder 28 to lose pressure disengaging rotating wick 27. According to a parallel timing cycle dependent upon the process distance between the second paper sheet supply 33 and the fuser 15, a paper sheet is fed from second sheet supply 33 through the transfer station, the sheet transport 21 and through the fuser 15 thereby spreading the release liquid and assisting in removing the small spots of excess liquid. The transparency stock is fed out of the first sheet supply 32 immediately after the paper stock is fed. The paper sheet can receive an image from the web 1 when passing through the transfer station, either in mono-color or multi-color. Obviously, if the image placed on the paper is multi-color the timing of feeding the transparency must be adjusted accordingly. Note that the color transparency can receive as many as four images and can arrive at the fusing station 15 with a separation of three image frames between it and the sheet of paper from the second sheet supply.

Although the invention operates best when there is substantial time after removal of the wick from the fusing roller surface for the surface tension of the liquid to smooth the release liquid, when there is contact by the pressure roller during that time and when there is the application of the intermediate paper sheet, any of these mechanisms can be used alone and will give substantial improvement compared to continued contact between the wick and the roller during fixing.

It is a common practice, in most multiple copy situations, to separate transparencies by a sheet of paper, which sheet of paper may in fact have the same material printed thereon or be blank. The transparencies are easier to read and to physically separate with paper stock between them for the person using them in a presentation or other similar environment. Present copiers on the market can be programed to automatically interleaf transparencies with paper stock from separate supplies with or without images on the paper. Thus, in most situations, apparatus operating in the second mode not only improves the quality of the fusing, it automatically provides an interleaved output that is desired.

If the interleaved output is not desired and the apparatus has two output trays, the paper sheets can be fed to a tray different from the transparencies.

The invention has its best application with multicolor transparencies, because the output of the copier or printer is already reduced to superimpose multiple images and because the buildup of toner from several colors makes fusing more difficult. However, it is also useful with single color transparencies if that color is not black. Depending upon the parameters of the system, this may require skipping one or more frames, especially if interleaving is not a desired output.

According to the preferred embodiment, when operating in the second mode, the wick can be reengaged immediately after fixing each transparency and then disengaged according to the invention the appropriate time prior to the next transparency. Alternatively, if enough liquid tends to remain on the roller 26 to fix several sheets, it is within the scope of the invention and the skill of the art to program logic and control 35 to not reengage the wick for the number of transparencies appropriate for the parameters of the system, with or without interleaving. I have "seen" that transparency removes same amount of oil as paper. However, a transparency and paper will remove more than just transparency alone.

The invention has been described in detail with particular reference to a preferred embodiment thereof, but it will be understood that variations and modifications can be effected within the spirit and scope of the invention as described hereinabove and as defined in the appended claims.

We claim:

1. A process of fixing color toner images carried on a resin based sheet using a fixing device of the type having at least one roller having a surface which contacts the toner image during fixing and to which a release liquid is applied by a release liquid applying means to prevent the offset of toner to the roller surface, said process including the steps of applying release liquid to said roller surface, using a wick having a fabric surface that rotates with the surface of said one roller, terminating the application of release liquid to said surface, then contacting said surface with a sheet of material more absorbent of said liquid than said resin based sheet, and then carrying out said fixing process including the step of bringing said roller surface into contact with said toner image without recontacting the wicking roller.

2. A process of fixing color toner images carried on a resin based sheet using a fixing device of the type having at least one roller having a surface which contacts the toner image during fixing, said process including the steps of engaging said surface with a release liquid applying wick to apply release liquid thereto, said wick being of type having an irregular fabric surface that rotates with the roller surface, then disengaging the wick from the roller surface, then contacting said surface with a sheet of material more absorbent of said liquid than said resin based sheet, and then carrying out said fixing process including the step of bringing said roller surface and said toner image into contact without reengaging the wick with said surface.

3. The process according to claim 2 wherein said contacting step is accomplished by passing a sheet of paper through contact with said roller.

4. The process according to claim 3 wherein said fixing device is of the type having two rollers between which both of said sheets are fed.

5. A process of fixing color toner images carried on a resin based sheet using a fixing device of the type having first and second rollers between which said sheet is passed to fix the image, at least said first roller being heated and having a surface which contacts the toner image during fixing and to which a release liquid is applied by a release liquid applying means to prevent the offset of toner to the roller surface, said process including the steps of applying release liquid to said first roller surface by engaging said surface with a fabric wicking surface mounted to roll with said surface, terminating the application of release liquid to said surface by disengaging said first roller surface and said wicking surface, rotating said rollers in contact with each other for at least one complete revolution of said first roller after said terminating step to lessen any local irregularities of release liquid on said surface, and then carrying out said fixing process including the step of bringing said roller surface and said toner image into contact.

6. The process according to claim 5 further including the step of passing a sheet of paper, with or without a toner image on it, between said rollers between said terminating and said carrying out steps.

7. A printer or copier of the type in which dry toner is applied to a receiving sheet in image configuration and then fixed by a fixing device of the type having a pair of rollers which contact each other to form a nip and rotate during fixing to drive a toner carrying sheet through the nip, a rotatable wick for applying a viscous release liquid directly to the surface of one of said rollers, said wick having an irregular surface which engages and rolls with said roller, means for moving the wick into and out of engagement with said roller to control the amount of liquid applied to the roller, and control means for controlling the moving means, said printer or copier having a first mode of operation in which the control means causes the moving means to move the applying means into such engagement according to a first program designed to prevent buildup of release liquid on the roller over a: series of fixed sheets, characterized by said printer or copier having a second mode o operation used for specific receiver sheet and toner conditions in which said control means causes the rollers to rotate and the moving means to move the rotatable wick according to a second program in which said wick is moved into engagement with said roller to apply release liquid to said roller and is then removed from such engagement, while the rollers continue to rotate in contact with each other for a time period prior to said sheet arriving at said fixing device; said time period being such that any irregularity imparted to the surface of the release liquid on the roller by the wick has been substantially lessened by the time the sheet arrives in the nip.

* * * * *